US006290526B1

(12) United States Patent
Minami et al.

(10) Patent No.: US 6,290,526 B1
(45) Date of Patent: Sep. 18, 2001

(54) LAMP SOCKET

(75) Inventors: Fumihiro Minami; Hiroki Ushio; Mutsuo Sekiya, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/772,979

(22) Filed: Jan. 31, 2001

(30) Foreign Application Priority Data

Jul. 31, 2000 (JP) ..... 12-231948

(51) Int. Cl.[7] ..... K01R 4/50

(52) U.S. Cl. ..... 439/336; 439/230

(58) Field of Search ..... 439/336, 335, 439/337, 699.2, 23 V

(56) References Cited

U.S. PATENT DOCUMENTS

| | | | | |
|---|---|---|---|---|
| 4,940,422 | * | 7/1990 | Forish et al. | 439/356 |
| 5,630,729 | * | 5/1997 | Francis | 439/548 |
| 5,924,884 | * | 7/1999 | Sato et al. | 439/336 |
| 6,056,575 | * | 5/2000 | Sato et al. | 439/336 |
| 6,183,286 | * | 2/2001 | Hofmann | 436/336 |
| 6,224,428 | * | 5/2001 | Chen et al. | 439/694 |

FOREIGN PATENT DOCUMENTS 10-64643 3/1998 (JP) .

* cited by examiner

*Primary Examiner*—Tulsidas Patel
(74) *Attorney, Agent, or Firm*—Sughrue, Mion, Zinn, Macpeak & Seas, PLLC

(57) ABSTRACT

A lamp socket has a socket body with a plugging section in which a lamp plug is removably plugged. In the plugging section, there are a central terminal and a side terminal. An insulation seal member provides electrical isolation between the central terminal and the side terminal and is prevented from dislodging when the lamp plug is removed from the socket body by forming a structure from at least one of the central terminal and the insulation seal member which are adapted to fit into one another. Thus, the removal of the insulation seal member when the lamp plug is plugged out of the socket body can be prevented by the central terminal of the socket body and/or the insulation seal member itself. Therefore, there is no need to install an additional component such as a stopper. Thus, the number of components and its manufacturing cost can be reduced compared with a conventional lamp socket. In addition, this avoids problems such as defects in the lamp or the lighting mechanism caused when a lamp is detached from the lamp socket and replaced with new one, and the insulation seal member thereof is missing, displaced, jammed, cracked or the like when a lamp plug with a replacement lamp is re-plugged in the lamp socket.

8 Claims, 6 Drawing Sheets

LAMP SOCKET

BACKGROUND OF THE INVENTION

1. Field of the Invention

The present invention relates to a lamp socket into which a lamp plug is designed to fit, for example, a lamp socket for mounting a lamp such as a high-intensity discharge lamp to be used as a headlight on the front of an automobile or another vehicle.

2. Description of the Related Art

Recent years, lighting devices to be used as headlights of automobiles and so on have been shifted from halogen lamp systems to high-intensity discharge (HID) lamp systems because of their advantages with respect to large light pencils, excellent lamp efficiencies, and long lasting qualities. The typical lighting device of the HID lamp system mainly comprises a discharge lamp bulb which is removably attached to a lamp plug, an igniter that allows the instantaneous generation of high-voltage discharge, and a ballast for controlling the operation of the igniter. The HID lamp system further comprises a lamp socket in which the lamp plug of the lighting device can be removably plugged. The lamp socket mainly comprises a high-voltage side terminal, a low-voltage side terminal, and. an insulation seal member. In the lamp socket, the insulation seal member is arranged between the high-voltage side terminal and the low-voltage side terminal for providing a perfect electrical insulation between them because a high voltage (e.g., 30 KV) generated by the igniter is momentarily applied to the discharge lamp.

Concretely, the conventional lamp socket is constructed as follows. That is, the high-voltage side terminal is positioned at a center of the lamp socket so that it electrically contacts to a high-voltage side terminal of the lamp plug. On the other hand, the low-voltage side terminal is located in the proximity of a peripheral portion of the lamp socket so that it electrically contacts to a low-voltage side terminal of the lamp plug. In addition, the insulation seal member is arranged between the high-voltage side terminal and the low-voltage side terminal in order to completely electrically isolate these components. Therefore, both insulation and withstand voltage properties of the boundary between the high-voltage side terminal and the low-voltage side terminal of the lamp socket are enhanced in order to support a high voltage applied to the lamp plug.

In the lamp socket having the structure described above, an insulation seal member is fixed on the lamp socket only by sliding the insulation seal member onto the outside of a tubular guide portion that surrounds the high-voltage side terminal. If the lamp plug is pulled out of the lamp socket for replacing a lamp bulb with new one, the position of the insulation seal member may be left near the lamp plug so that it may be removed from the lamp socket as the lamp plug is pulled out of the lamp socket. Thus, a new lamp may be fitted into the lamp socket without realizing that the insulation seal member has been removed. This results in an insufficient electrical insulation between the high-voltage side terminal and low-voltage side terminal. Such an insufficient electrical insulation causes serious damage to a lighting mechanism or the like.

For solving such a disadvantage, for example, the Japanese Patent Laying-open No. 10-64643 (1998) discloses a lamp socket with an additional structural component for preventing the insulation seal member from dislodging when the lamp plug is pulled out of the lamp socket.

FIG. 10 is a cross sectional view of the conventional lamp socket disclosed in the Japanese Patent Laying-open No. 10-64643 (1998).

In the figure, the reference numeral 1 denotes a lamp such as a HID lamp bulb, 2 denotes a lamp plug having a low-voltage side terminal 3 in the shape of a cylinder and a high-voltage side terminal 4 arranged in the center of the lamp plug 2. The reference numeral 5 denotes a lamp socket into which the lamp plug 2 can be removably plugged, 6 denotes a tubular guide portion which is integrally molded in the inside of the lamp socket 5, and 7 denotes a high-voltage side terminal. The high-voltage side terminal 7 is fixed in place by guiding it along the inner peripheral surface of the tubular guide portion 6 and inserting one end portion of the terminal 7 through an a slit formed on the bottom of the lamp socket 5. Thus, the high-voltage side terminal 7 is positioned in the tubular guide portion 6 so that it is able to make an electrical contact with a high-voltage side terminal 4 of the lamp plug 2 as shown in the figure. Furthermore, the reference numeral 8 denotes a low-voltage side terminal which is fixed in place by inserting one end portion of the terminal 8 through a predetermined place between an inner peripheral surface of the lamp socket 5 and an outer peripheral surface of the guide portion 6. Such a low-voltage side terminal 8 is able to make electrical contact with a low-voltage side terminal 3 of the lamp plug 2 as shown in the figure. The reference numeral 9 denotes a tubular insulation seal member which is placed over the outer peripheral surface of the tubular guide portion 6 to provide electrical isolation between the high-voltage side (i.e., terminals 4, 7) and the low-voltage side (i.e., terminals 3, 8). The reference numeral 10 denotes a tubular stopper having a flanged portion 10*a* horizontally extended outward from its one end. As shown in the figure, the flanged portion 10*a* is provided as a press plate for pressing down the insulation seal member 9 in the direction of fitting the insulation seal member 9 onto the guide portion 6.

In other words, the insulation seal member 9 can be fixed on the conventional lamp socket as follows for preventing the removal of the insulation seal member 9 from the guide portion 6.

Firstly the insulation seal member 9 is fitted onto the outer periphery of the tubular guide portion 6 of the lamp socket 5. Then, the tubular stopper 10 is inserted into the inside of the tubular guide portion 6 to fit it in place. Simultaneously, the press plate 10*a* of the stopper 10 comes into press-contact with an upper end of the guide portion 6 that extends toward the lamp plug 2 from the bottom of the lamp socket 5. Consequently, the insulation seal member 6 is prevented from detaching from the tubular guide portion 6.

As the conventional lamp socket is constructed as described above, the stopper 10 must be provided as an additional member for preventing the detachment of the insulation seal member 9. Therefore, the number of the structural components of the lamp socket 5 is increased to that extent and the structural complexity of the lamp socket 5 is increased. Thus the manufacturing cost of such a lamp socket 5 rises.

Moreover, the insulation seal member 9 is generally prepared by molding a silicon rubber, in order to obtain sufficient flexibility to adhere to the boundary between the inner peripheral surface of the lamp plug 2 and the outer peripheral surface of the insulation seal member 9. If the lamp plug 2 is pulled out of the lamp socket 5 to replace a bulb 1 with new one or the like, the stopper 10 prevents the detachment of the insulation seal member 9. However, the insulation seal member 9 may be partially curled up or peeled off because of its excellent flexibility and poor tearing strength. Therefore, it is very difficult to keep the normal insulation performance or the like if the insulation seal member 9 is deformed.

SUMMARY OF THE INVENTION

The present invention is implemented to solve the foregoing problems. Accordingly, it is a first object of the present invention to provide a lamp socket that prevents the removal of an insulation seal member without providing an additional structural component such as a stopper for holding the insulation seal member in place, so that there is no need to install an additional component. This allows the prevention of any troubles including defects of lamp and lighting mechanism caused when a lamp is detached the lamp socket and replaced with new one, and the insulation seal member thereof is missing, displaced, jammed, cracked or the like when a lamp plug with a replacement lamp is re-plugged in the lamp socket.

It is a second object of the present invention is to provide a lamp socket that prevents the removal of an insulation seal member by a terminal itself provided on a socket body.

It is a third object of the present invention is to provide a lamp socket that prevents the removal of an insulation seal member by the structural relationship between a terminal provided on a socket body and the insulation seal member.

In the first aspect of the present invention, a lamp socket comprises: a socket body having a plugging section in which a lamp plug is removably plugged; a central terminal and a side terminal formed on the plugging section of the socket body; an insulation seal member that provides electrical isolation between the central terminal and the side terminal; and a means for preventing the insulation seal member from dislodging when the lamp plug is removed from the socket body, which is formed from at least one of the central terminal and the insulation seal member which are adapted to fit into one.

Here, the a central terminal of a lamp socket may comprises: a terminal leg to be inserted into a socket body and fixed thereon; a pair of contact hooks to be electrically connected to a lamp plug, where the contact hooks are mirror images of each other; and a positioning part that defines a relative position of the pair of contact hooks and extends to the contact hooks and the terminal leg, wherein a means for preventing the insulation seal member from dislodging when the lamp plug is removed from the socket body is formed at least one of the contact hooks and the positioning part.

An insulation seal member may be constructed of an external cylindrical portion and an internal cylindrical portion which are concentrically formed together, and a means for preventing the insulation seal member from dislodging may be formed on a central terminal and fixes the internal cylindrical portion with respect to the radius of the internal cylindrical portion.

An insulation seal member may be provided as a single cylindrical member, and a means for preventing the insulation seal member from dislodging may be formed on a central terminal and holds the insulation seal member in the direction of plugging a lamp plug into a socket body.

A means for preventing an insulation seal member from dislodging may have an inward projection formed on an inner peripheral surface of an inner cylindrical portion of the insulation seal member and a recessed portion formed on a portion of a central terminal which comes into contact with the inner cylindrical portion, where the inward projection is able to fit to the recessed portion.

A means for preventing an insulation seal member from dislodging may be formed on a pair of contact hooks of a central terminal so that each contact hook has an outer bent portion that presses the insulation seal member in the direction of plugging a lamp socket into a socket body.

A means for preventing an insulation seal member from dislodging may be formed on a pair of contact hooks of a central terminal so that each contact hook has a curled portion that presses the insulation seal member in the direction of plugging a lamp socket into a socket body.

In the second aspect of the present invention, a lamp socket may comprise: a socket body having a plugging section in which a lamp plug is removably plugged; a central terminal having a pair of contact hooks and a side terminal formed on the plugging section of the socket body; an insulation seal member that provides electrical isolation between the central terminal and the side terminal and is constructed of an external cylindrical portion and an internal cylindrical portion which are concentrically formed together; and a means for preventing the insulation seal member from dislodging when the lamp plug is removed from the socket body, where the contact hooks are provided as at least a part of the means and extends in the opposite directions with respect to each other when the lamp plug is plugged into the socket body and holds the internal cylindrical portion in place in the predetermined direction of the internal cylindrical portion.

The above and other objects, effects, features and advantages of the present invention will become more apparent from the following description of embodiments thereof taken in conjunction with the accompanying drawings.

DETAILED DESCRIPTION OF THE PREFERRED EMBODIMENT

Preferred embodiments of the present invention will now be described with reference to the accompanying drawings.

Embodiment 1

Figure 1:
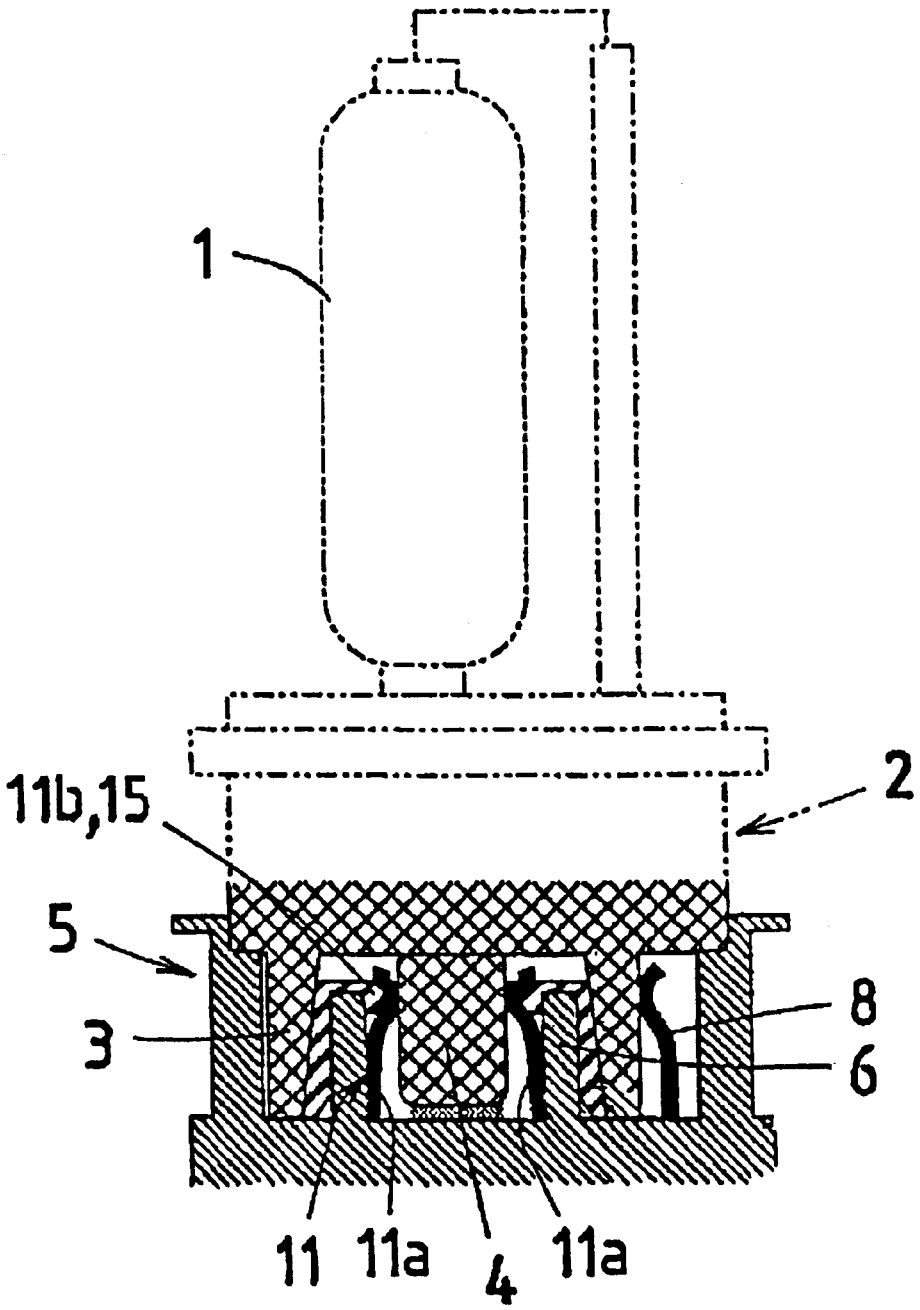
FIG. 1 is a block diagram that shows a configuration of a first embodiment (Embodiment 1) of a lamp socket in accordance with the present invention, where a lamp plug is plugged in a lamp socket.
Figure 2:
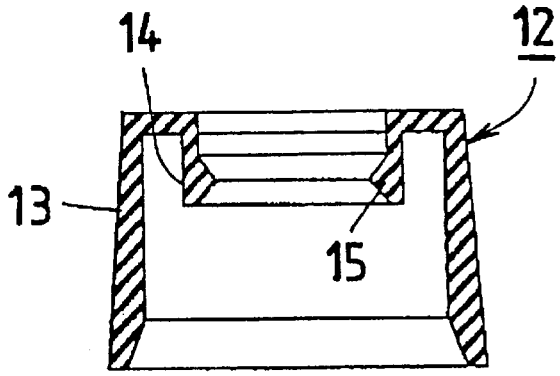
FIG. 2 is an enlarged cross sectional diagram of an insulation seal member to be installed in the lamp socket shown in FIG. 1.
Figure 3:
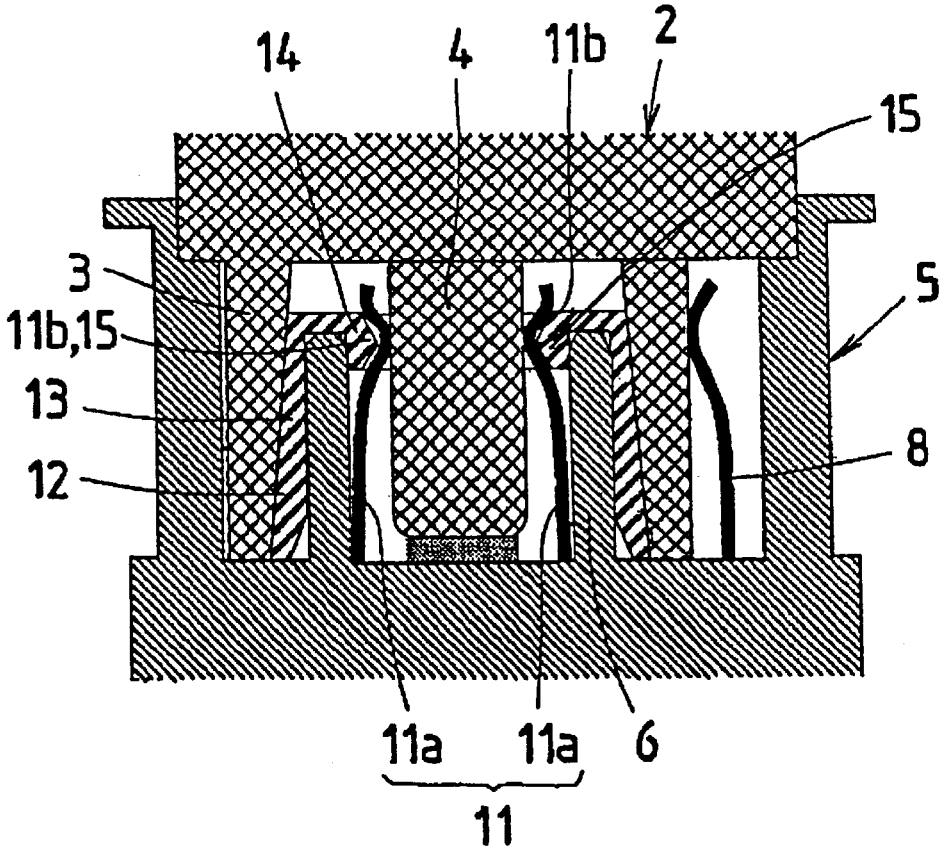
FIG. 3 is an enlarged cross sectional diagram of the main components of the lamp socket shown in FIG. 1.
Figure 10:
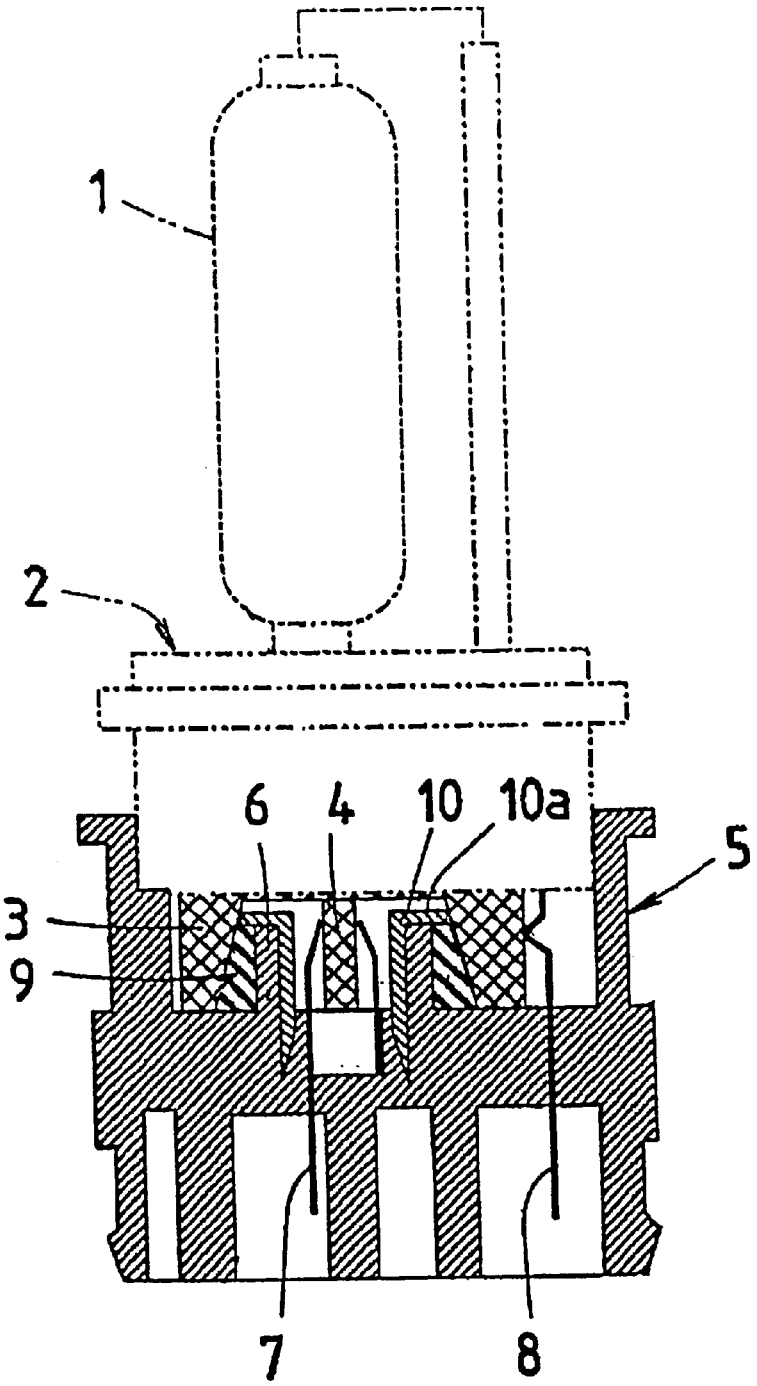
FIG.10 PRIOR ART
FIG. 10 is a cross sectional view of the conventional lamp socket.

FIG. 1 is a block diagram that shows a configuration of a first embodiment (Embodiment 1) of a lamp socket in accordance with the present invention, where a lamp plug is plugged in a lamp socket. FIG. 2 is an enlarged cross sectional diagram of an insulation seal member to be installed in the lamp socket shown in FIG. 1. FIG. 3 is an enlarged cross sectional diagram of the prime constituents of the lamp socket shown in FIG. 1. In these figures, the same reference numerals are provided on the same constituents as those of FIG. 10 to omit redundant descriptions from the following discussion in the interest of simplicity. In the figures, the reference numeral 11 denotes a high-voltage side terminal (hereinafter, also referred to as a central terminal) provided as a bent plate obtained by a sheet-metal press working. The high-voltage side terminal 11 is fixed in place by inserting one end portion of the terminal 11 through a slit formed on the bottom of a socket body (hereinafter, also referred to as a lamp socket) 5. The high-voltage side terminal 11 extends along the inside of a tubular guide portion 6. As shown in the figure, the central terminal 11 has contact hooks 11*a*, 11*a* that are symmetrical with each other with respect to the length of the terminal 11 and positioned in the inside of the guide portion 6. The reference numeral 11*b* denotes a recessed portion formed on the back side in the proximity of the tip of each contact hook 11*a*. The recessed portion 11*b* is formed during the sheet-metal press working mentioned above.

Furthermore, the reference numeral 12 denotes an insulation seal member for electrically isolating the high-voltage side of the lamp plug 2 and the low-voltage side of the socket body 5 and also isolating the low-voltage side of the lamp plug 2 and the high-voltage side of the socket body 5. The insulation seal member 12 comprises an external cylindrical part 13 and an internal cylindrical part 12. The internal cylindrical part 12 is shorter than the external cylindrical part 13. These parts 12, 13 are molded together so that the internal cylindrical part 12 extends concentrically from the top end to the inside of the external cylindrical part 13. As shown FIG. 2, there is an inward projection 15 which is integrally formed on the inner peripheral surface of the internal cylindrical part 14. The projection 15 is provided as a sharp-pointed rib extended in the direction of the radius of the internal cylindrical part 14. Such a projection 15 can be fitted to the recessed portion 11*b* of the high-voltage side terminal 11. The inward projection 15 is shaped like a rectangle in cross section as shown in FIG. 2 but not limited to such a shape. It may be shaped like a semicircle, trapezoid, or the like in cross section. In addition, it is also possible to form two or more inward protrusions 15 concentrically arranged in parallel with each other on the internal peripheral surface of the internal cylindrical part 14. Furthermore, two or more discontinues inward protrusions 15 may be formed on the internal peripheral surface of the internal cylindrical part 14 in the direction of the radius of thereof. In FIG. 2, the internal cylindrical part 14 are formed like a perfect cylinder extended inwardly from the top of the external cylindrical part 13. However, it is not limited to such a cylindrical structure. It may be formed, for example, like two or more curved plates symmetric with respect to a central axis of the external cylindrical part 13.

Accordingly, if the recessed portion 11*b* of the high-voltage side terminal 11 and the inward projection 15 of the insulation seal member 12 are assembled in the socket body 5, they comprise a means for preventing the insulation seal member 12 from coming off the socket body 5. In this first embodiment, the configuration of the high-voltage terminal 11 is not described in detail. However, it is the same as that of Embodiment 2 described below, so that it has both the terminal leg 16 and the positioning part 17 with contact hooks 11*a*, 11*a* formed on both sides thereof by the bent-press working in a bilateral symmetrical manner (see FIG. 5).

Next, the procedure of assembling the low-voltage side terminal (side terminal) 8, the high-voltage side terminal 11, and the insulation seal member 12 in the socket body 5 will be explained in the following description.

At first, the external cylindrical part 13 of the insulation seal member 12 is fitted onto the external periphery of the guide portion 6 of the socket body 5. At the same time, the internal cylindrical part 14 of the insulation seal member 12 is fitted in the guide portion 6 and a part of the guide portion 6 is covered with the insulation seal member 12.

Subsequently, the low-voltage side terminal 8 is fixed in place by inserting one end thereof through the bottom of the socket body 5 from a space between the inner periphery of the socket body 5 and the external periphery of the guide portion 6. In addition, the high-voltage side terminal 11 is fixed in place by inserting one end thereof through the bottom of the socket body 5 from the inside of the guide portion 6. In this state, the inward projection 15 of the insulation seal member 12 and the contact hooks 11*a*, 11*a* are engaged with each other. Accordingly, the lamp plug 2 can be plugged into such an assembled lamp socket 5.

According to the first embodiment described above, the lamp socket 5 has the insulation seal member 12 that consists of the external cylindrical part 13 and the internal cylindrical part 15. In addition, the recessed portion 11*b* is formed on the back side of each contact hook 11*a* of the high-voltage side terminal 11 while the inward projection 15 is formed on the internal periphery of the internal cylindrical part 14 of the insulation seal member 12. Therefore, the recessed portion 11*b* and the inward projection 15 are engaged with each other when the high-voltage side terminal 11 and the insulation seal member 12 are assembled in the socket body 5.

Therefore, such a configuration of the lamp socket 5 has the effect of preventing the removal of the insulation seal member 12 from the guide portion 6 whether or not the insulation seal member demonstrates a propensity to remain near to the plug when the lamp plug 2 is pulled out of the lamp socket 5 for replacing the lamp bulb 1 with new one. This is due to the following reasons. Firstly, the inner projection 15 is fitted to the recessed portion 11*b* of the high-voltage side terminal 11 fixed on the socket body 5. Under such a fitting state, Secondly, the proximity of the recessed portion 11*b* of the high-voltage side terminal 11 is sandwiched between the high-voltage side terminal 4 of the lamp plug 2 and the inner cylindrical portion 14 of the insulation seal member 12. On the other hand, the inner cylindrical portion 14 is sandwiched between the contact hooks 11*a*, 11*a* of the high-voltage side terminal 4 and the guide portion 6 of the socket body 5.

Embodiment 2

Figure 4:
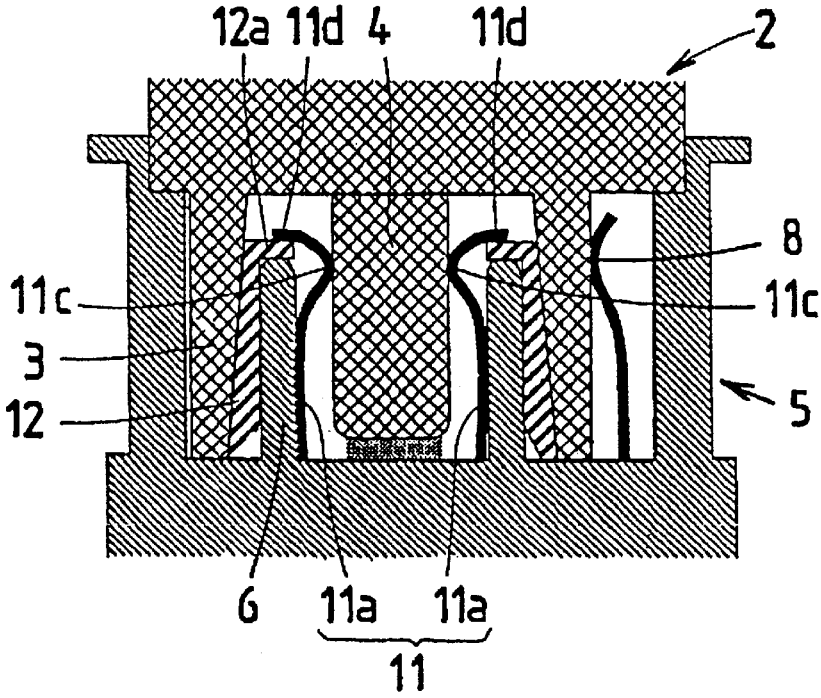
FIG. 4 is a block diagram that shows a configuration of a second embodiment (Embodiment 2) of a lamp socket in accordance with the present invention, where a lamp plug is plugged in a lamp socket.

FIG. 4 is a block diagram that shows a configuration of a second embodiment (Embodiment 2) of a lamp socket in accordance with the present invention, where a lamp plug is plugged in a lamp socket. In the figure, the same reference numerals are provided on the same constituents as those of FIGS. 1 to 3 and FIG. 10 to omit the redundant descriptions thereof from the following discussion in the interest of simplicity. In the figure, the reference numeral 12*a* denotes an inner collar portion integrally-molded with on the top side of the insulation seal member 12 that is provided as a single cylindrical structure. That is, the inner collar portion 12*a* is concentrically formed on the top side of the insulation seal member 12 and inwardly extended in the direction of the radius thereof. The inward collar portion 12*a* makes contact with the tip of the guide portion 6 of the socket body 5 at the position where the insulation seal member 12 is fixed on the guide portion 6.

Figure 5:
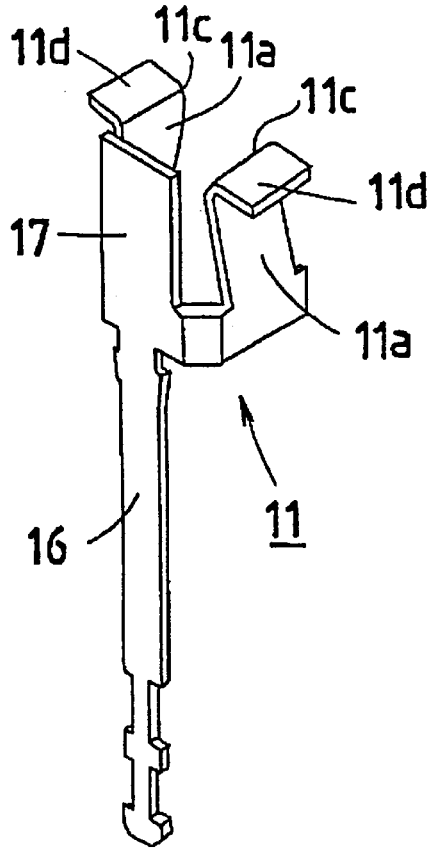
FIG. 5 is a perspective diagram that illustrates the whole of the high-voltage side terminal shown in FIG. 4.

FIG. 5 is a perspective diagram that illustrates the whole of the high-voltage side terminal shown in FIG. 4. In the figure, the reference numeral 16 denotes a terminal leg of the high-voltage side terminal 11 to be fixed in place by being inserted into a predetermined portion of the socket body 5 and 17 denotes a positioning part formed on the upper portion of the terminal leg 16. A pair of contact hooks 11*a* is formed on both sides of the positioning part by a sheet-metal press working so as to create mirror images of each other.

In FIG. 4 and FIG. 5, the reference numerals 11*c*, 11*c* denote curved portions of the contact hooks 11*a*, 11*a*, which are formed by curving the contact hooks 11*a*, 11*a* in their inward directions so as to face each other, respectively. Thus, the curved portions 11*c*, 11*c* are provided for holding the high-voltage side terminal 4 of the lamp plug 2 to make electrical contacts among them. Furthermore, the reference numerals lid, 11*d* denote outer bent portions with tips outwardly directing away from each other. Thus, the inner collar portion 12*a* of the insulation seal member 12 can be held between the tip of the guide portion 6 of the socket body 5 and the outer bent portion 11*d*. Such a configuration of the lamp socket 5 allows a means for preventing the removal of the insulation seal member because the outer bent portions lid, 11*d* press the insulation seal member 12 against the guide portion 6 in the direction corresponding to plugging the lamp plug 2 in the lamp socket 5.

Next, the procedure of assembling the low-voltage side terminal (side terminal) 8, the high-voltage side terminal 11, and the insulation seal member 12 in the socket body 5 will be explained in the following description.

At first, the insulation seal member 12 is fitted on the external periphery of the guide portion 6 of the socket body 5, so that the inward collar portion 12*a* of the insulation seal member 12 makes a press contact with the upper end of the guide portion 6 of the socket body 5.

Subsequently, the low-voltage side terminal 8 and the high-voltage side terminal 11 are fixed in place by the insertion thereof on the socket body 5 in the same way as those in Embodiment 1. In this state, the contact hooks 11*a*, 11*a* make contact with the inner peripheral surface of the guide portion 6 of the socket body 5. The outer bent portions 11*d*, 11*d* of the respective contact hooks 11*a*, 11*a* press the inner collar portion 112*a* of the insulation seal member 12 against the upper end of the guide portion 6 so that the collar portion 12*a* is held between the outer bent portions 11*d*, 11*d* and the guide portion 6. Consequently, the insulation seal member 12, the low-voltage side terminal 8, and the high-voltage side terminal 11 are assembled together in the lamp socket 5.

If the lamp plug 2 is plugged in such an assembled lamp socket 5, the high-voltage side terminal 4 of the lamp plug 2 is inserted into a space between the contact hooks 11*a*, 11*a* and the curved portions 11*c*, 11*c* of the contact hooks 11*a*, 11*a* that hold the high-voltage side terminal 4 of the lamp plug 2 to make electrical contact with each other. In this case, furthermore, the low-voltage side terminal 3 of the lamp plug 2 is inserted into a space between the insulation seal member 12 and the low-voltage side terminal 8 of the lamp socket 5 to make electrical contact with each other.

According to the second embodiment described above, the lamp socket is constructed so that the inner collar portion 12*a* is formed on one end of the cylinder-shaped insulation seal member 12 while the external bent portions 11*d*, 11*d* are formed on the contact hooks 11*a*, 11*a* of the high-voltage side terminal 11 of the socket body 5 to hold the inner collar portion 12 between the external bent portions lid, 11*d* and the upper end of the guide portion 6 of the socket body 5. Therefore, such a configuration of the lamp socket 5 has the effect of keeping a stable insulation function thereof by preventing the removal of the insulation seal member 12 together with the lamp plug 2 (the low-voltage side terminal 3) from the guide portion 6 when the lamp plug is pulled out of the lamp socket 5. Embodiment 3

Figure 6:
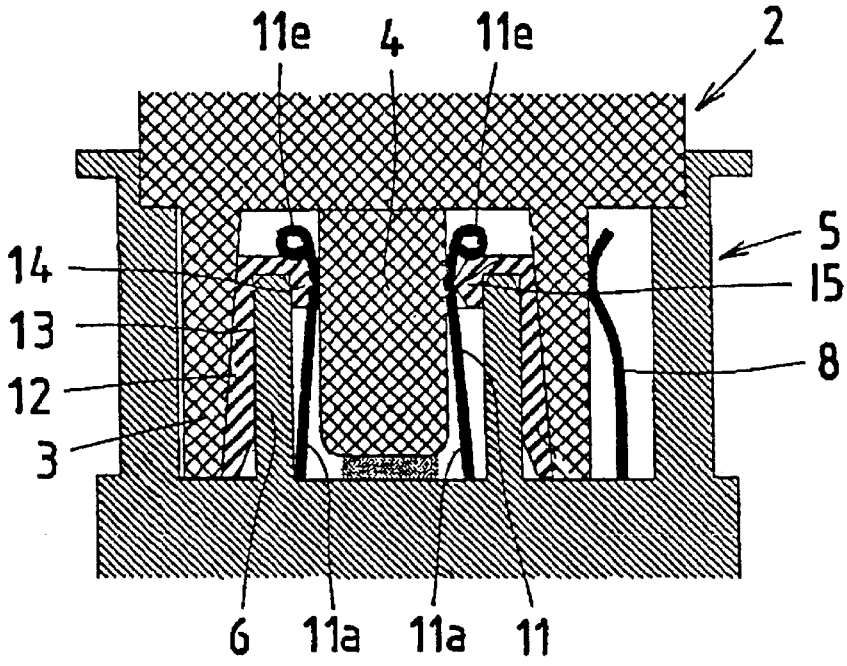
FIG. 6 is a block diagram that shows a configuration of the third embodiment (Embodiment 3) of a lamp socket in accordance with the present invention, where a lamp plug is plugged in a lamp socket.
Figure 7:
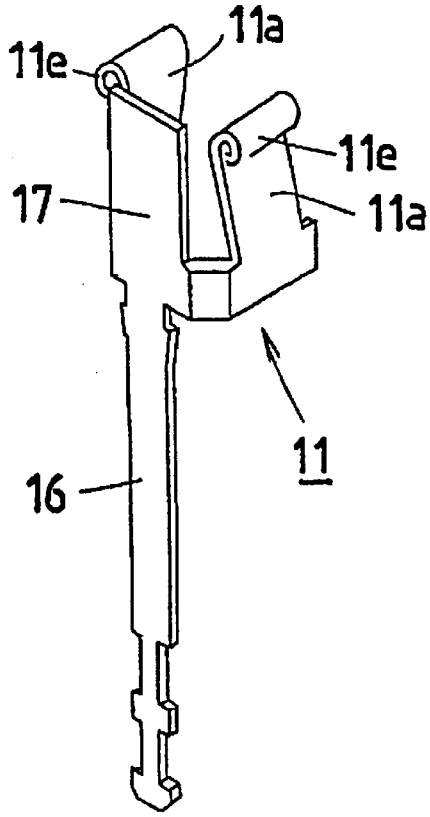
FIG. 7 is a perspective diagram that shows the whole of high-voltage side terminal of the lamp socket in FIG. 6.

FIG. 6 is a block diagram that shows a configuration of the third embodiment (Embodiment 3) of a lamp socket in accordance with the present invention, where a lamp plug is plugged in a lamp socket. In addition, FIG. 7 is a perspective diagram that shows the whole of high-voltage side terminal of the lamp socket in FIG. 6. In these figures, the same reference numerals are provided on the same components as those of FIGS. 1 to 3 and FIG. 10 to omit the description thereof from the following discussion in the interest of simplicity. In the figure, the reference numerals 11*e*, 11*e* denote curled portions that are formed on the upper ends of the contact hooks 11*a*, 11*a* of the high-voltage side terminal 11, respectively. These curled portions 11*e*, 11*e* act as a means for preventing the removal of the insulation seal member 12 from the guide portion 6 of the socket body 5 by pressing the upper end of the inner cylindrical portion 14 of the insulation seal member 12 against the guide portion 6 of the socket body 5 in the direction of plugging the lamp plug 2 in the lamp socket 5.

In the third embodiment, by the way, the insulation seal member 12 comprises the external cylindrical part 13 and the internal cylindrical part 14 just as in the case of Embodiment 1, where the inward projection 15 is integrally formed on the inter peripheral surface of the internal cylindrical part 14. In addition, a portion of the contact hook 11*a* to be fit to the inward projection 15 is formed by bending the contact hook 11*a* along the contours of the inward projection 15.

According to the third embodiment described above, the lamp socket is constructed so that the curled portions 11*e*, 11*e* are formed on the upper ends of the respective contact hooks 11*a*, 11*a* to press the inner cylindrical portion 14 of the insulation seal member 12 against the guide portion 6 of the socket body 5 in the direction of plugging the lamp plug 2 in the lamp socket 5. Therefore, such a configuration of the lamp socket 5 has the effect of keeping a stable insulation function thereof because of preventing the removal of the insulation seal member 12 together with the lamp socket 2 from the guide portion 6 when the lamp plug is pulled out of the lamp socket 5.

Embodiment 4

Figure 8:
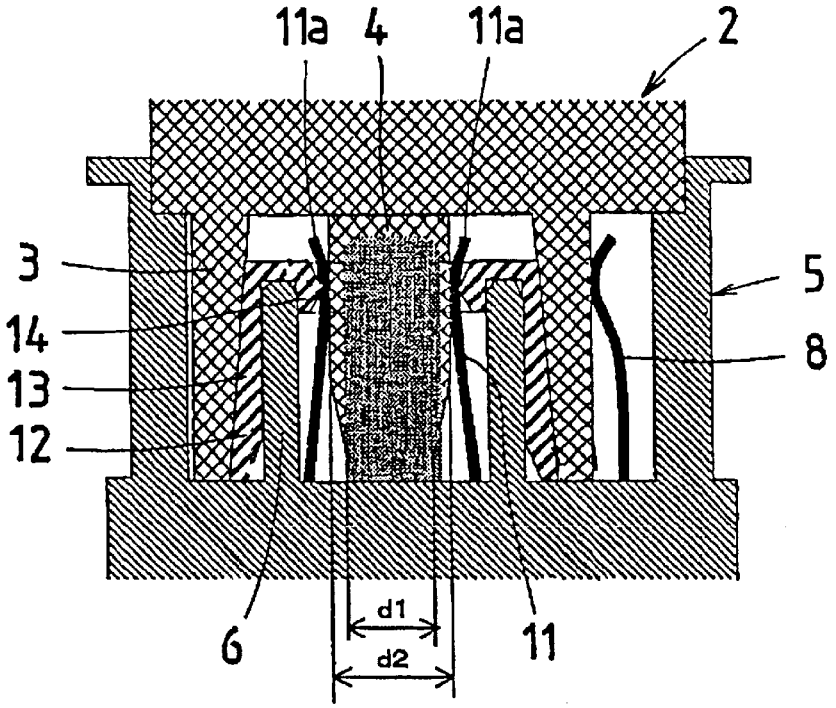
FIG. 8 is a block diagram that shows a configuration of the fourth embodiment (Embodiment 4) of a lamp socket in accordance with the present invention, where a lamp plug is plugged in a lamp socket.
Figure 9:
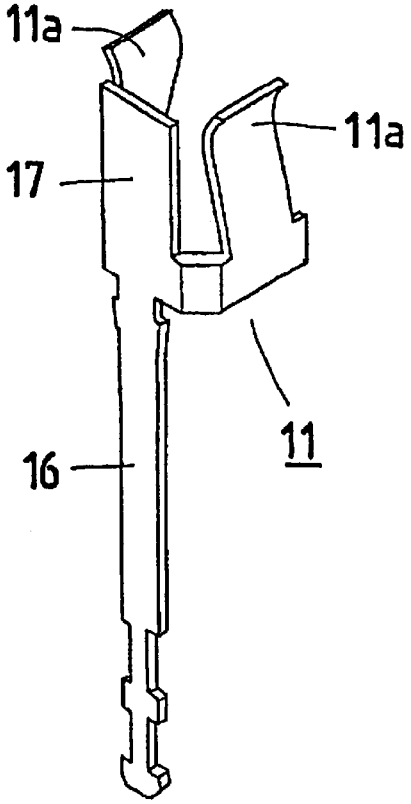
FIG. 9 is a perspective diagram that shows the whole of high-voltage side terminal of the lamp socket in FIG. 8.

FIG. 8 is a block diagram that shows a configuration of the fourth embodiment (Embodiment 4) of a lamp socket in accordance with the present invention, where a lamp plug is plugged in a lamp socket. In addition, FIG. 9 is a perspective diagram that shows the whole of high-voltage side terminal of the lamp socket in FIG. 8. In these figures, the same reference numerals are provided on the same constituents as those of FIGS. 1 to 7 and FIG. 10 to omit the description thereof from the following discussion in the interest of simplicity.

In the fourth embodiment, by the way, the insulation seal member 12 is formed just as in the case of the first and third embodiments. On the other hand, the high-voltage side terminal 11 is formed so that contact hooks 11*a*, 11*a* are curved outwardly in the opposite directions to open up the space between their tips. If the lamp plug 2 is plugged in the socket body 5, therefore, the high-voltage side terminal 4 of the lamp plug 2 can be easily pushed into the space between the contact hooks 11*a*, 11*a* by opening up the space between the tips of the contact hooks 11*a*, 11*a* and held in place. In this state, on the other hand, each of the curved portions of the contact hooks 11*a*, 11*a* holds the inter cylindrical portion 14 of the insulation seal member 12 by the force outwardly generated by the insertion of the lamp plug 2.

Accordingly, the outwardly curving deformations of the contact hooks 11*a*, 11*a* in the different directions provide a means for preventing the removal of the insulation seal member 12 from the guide portion 6 when the lamp plug is pulled out of the lamp socket 5. It is preferred that the shortest distance "d1" between the contact hooks 11*a*, 11*a* before plugging the lamp plug 2 in the lamp socket 5 (i.e., before contacting with the high-voltage side terminal 4 of the lamp plug 2) is smaller than the diameter "d2" of the high-voltage side terminal 4 at the position where the contact hooks 11*a*, 11*a* make contact therewith after plugging the lamp plug 2 in the lamp socket 5.

According to the fourth embodiment described above, the lamp socket is constructed so that the contact hooks 11*a*, 11*a* are outwardly pushed in the opposite directions by the high-voltage side terminal 4 of the lamp plug 2 at the time of plugging the lamp plug 2 into the socket body 5. Simultaneously, the contact hooks 11*a*, 11*a* are outwardly curved enough to hold the internal cylindrical portion 14 of the insulation seal member 12. Therefore, such a configuration of the lamp socket 5 has the effect of keeping a stable insulation function thereof by preventing the removal of the insulation seal member 12 together with the lamp plug 2 from the guide portion 6 when the lamp plug 2 is pulled out of the lamp socket 5.

According to the present invention, as described above, a lamp socket is configured so that it comprises a socket body having a plugging section in which a lamp plug is removably plugged; a central terminal and a side terminal formed on the plugging section of the socket body; an insulation seal member that provides electrical isolation between the central terminal and the side terminal; and a means for preventing the insulation seal member from dislodging when the lamp plug is removed from the socket body, which is formed from at least one of the central terminal and the insulation- seal member which are adapted to fit into one another. Thus, the lamp socket of the present invention has the following advantages. Thus the number of components and its manufacturing cost can be reduced compared with a conventional lamp socket. In addition, the removal of the insulation seal member when the lamp plug is plugged out of the socket body can be prevented by the central terminal of the socket body and/or the insulation seal member itself. Therefore, there is no need to install an additional component such as a stopper. Furthermore, these advantages also allow the prevention of any troubles including defects of lamp and lighting mechanism caused when a lamp is detached from the lamp socket and replaced with new one, and the insulation seal member thereof is missing, displaced, jammed, cracked or the like when a lamp plug with a replacement lamp is re-plugged in the lamp socket.

According to the present invention, a central terminal is configured so that it comprises: a terminal leg inserted into a socket body and fixed thereon; a pair of contact hooks to be electrically connected to a lamp plug, where the contact hooks are mirror images of each other; and a positioning part that defines a relative position of the pair of contact hooks and extends to the contact hooks and the terminal leg. Thus a means for preventing the insulation seal member from dislodging when the lamp plug is removed from the socket body is formed from at least one of the contact hooks and the positioning part. Therefore, there is an advantage that the removal of the insulation seal member when the lamp plug is plugged out of the socket body can be prevented by the central terminal of the socket body itself.

According to the present invention, an insulation seal member is configured so that it comprises an external cylindrical portion and an internal cylindrical portion which are concentrically formed together. In addition, a means for preventing the insulation seal member from dislodging is formed on a central terminal and presses the internal cylindrical portion in the direction of the radius of the internal cylindrical portion to hold the insulation seal member in place. Therefore, the removal of the insulation seal member when the lamp plug is plugged out of the socket body can be prevented by the central terminal of the socket body itself.

According to the present invention, an insulation seal member is configured so that it is provided as a single cylindrical member, and a means for preventing the insulation seal member from dislodging is also formed on a central terminal and presses the insulation seal member in the direction of plugging a lamp socket into a socket body. Therefore, the removal of the insulation seal member when the lamp plug is plugged out of the socket body can be prevented by the central terminal itself.

According to the present invention, a means for preventing an insulation seal member from dislodging is configured so that it has an inward projection formed on an inner peripheral surface of an inner cylindrical portion of the insulation seal member and a recessed portion formed on a portion of a central terminal which comes into contact with the inner cylindrical portion, where the inward projection is able to fit to the recessed portion. Therefore, there is an advantage that the function of preventing the insulation seal member from dislodging when the lamp plug is plugged out of the socket body can be enhanced by the insulation seal member and the central terminal without requiring an additional component.

According to the present invention, a means for preventing an insulation seal member from dislodging is configures so that it is formed on a pair of contact hooks of a central terminal so that each contact hook has an outer bent portion that presses the insulation seal member in the direction of plugging a lamp socket into a socket body. Therefore, there is an advantage that the function of preventing the insulation seal member from dislodging when the lamp plug is plugged out of the socket body can be enhanced by use of only the central terminal.

According to the present invention, a means for preventing an insulation seal member from dislodging is configured so that it is formed on a pair of contact hooks of a central terminal so that each contact hook has a curled portion that presses the insulation seal member in the direction of plugging a lamp socket into a socket body. Therefore, there is an advantage that the function of preventing the insulation seal member from dislodging when the lamp plug is plugged out of the socket body can be enhanced by use of only the central terminal.

According to the present invention, a lamp socket is configured so that it comprises: a socket body having a plugging section in which a lamp plug is removably plugged; a central terminal having a pair of contact hooks and a side terminal formed on the plugging section of the socket body; an insulation seal member that provides electrical isolation between the central terminal and the side terminal and is constructed of an external cylindrical portion and an internal cylindrical portion which are concentrically formed together; and a means for preventing the insulation seal member from dislodging when the lamp plug is removed from the socket body, where the contact hooks extend in opposite directions when the lamp plug is plugged into the socket body and press the internal cylindrical portion in the direction of the radius of the internal cylindrical portion to hold the insulation seal member in place. Therefore, there is the advantage that the structure of the lamp socket is more simple than the conventional one and the function of preventing the insulation seal member from dislodging when the lamp plug is plugged out of the socket body can be enhanced by use of only the central terminal.

The present invention has been described in detail with respect to preferred embodiments, and it will now be obvious to those skilled in the art that changes and modifications may be made without departing from the invention in its broader aspects, and it is the intention, therefore, in the appended claims to cover all such changes and modifications as fall within in the true spirit of the invention.

What is claimed is:

1. A lamp socket comprising:

a socket body having a plugging section in which a lamp plug is removably plugged;

a central terminal and a side terminal formed on the plugging section of the socket body;

an insulation seal member that provides electrical isolation between the central terminal and the side terminal; and a means for preventing the insulation seal member from dislodging when the lamp plug is removed from the socket body, which is formed from at least one of the central terminal and the insulation seal member which are adapted to fit into one another.

2. A lamp socket as claimed in claim 1, wherein a central terminal comprises:

a terminal leg to be inserted into a socket body and fixed thereon;

a pair of contact hooks to be electrically connected to a lamp plug, where the contact hooks are mirror images of each other; and a positioning part that defines a relative position of the pair of contact hooks and extends to the contact hooks and the terminal leg, wherein a means for preventing the insulation seal member from dislodging when the lamp plug is removed from the socket body is formed at least one of the contact hooks and the positioning part.

3. A lamp socket as claimed in claim 1, wherein an insulation seal member is constructed of an external cylindrical portion and an internal cylindrical portion which are concentrically formed together, and a means for preventing the insulation seal member from dislodging is formed on a central terminal and presses the internal cylindrical portion in the direction of the radius of the internal cylindrical portion to hold the insulation seal member in place.

4. A lamp socket as claimed in claim 1, wherein an insulation seal member is provided as a single cylindrical member, and a means for preventing the insulation seal member from dislodging is formed on a central terminal and presses the insulation seal member in the direction of plugging a lamp socket into a socket body.

5. A lamp socket as claimed in claim 2, wherein a means for preventing an insulation seal member from dislodging has an inward projection formed on an inner peripheral surface of an inner cylindrical portion of the insulation seal member and a recessed portion formed on a portion of a central terminal which comes into contact with the inner cylindrical portion, where the inward projection is able to fit to the recessed portion.

6. A lamp socket as claimed in claim 2, wherein a means for preventing an insulation seal member from dislodging is formed on a pair of contact hooks of a central terminal so that each contact hook has an outer bent portion that presses the insulation seal member in the direction of plugging a lamp socket into a socket body.

7. A lamp socket as claimed in claim 2, wherein a means for preventing an insulation seal member from dislodging is formed on a pair of contact hooks of a central terminal so that each contact hook has a curled portion that presses the insulation seal member in the direction of plugging a lamp socket into a socket body.

8. A lamp socket comprising:

a socket body having a plugging section in which a lamp plug is removably plugged;

a central terminal having a pair of contact hooks and a side terminal formed on the plugging section of the socket body;

an insulation seal member that provides electrical isolation between the central terminal and the side terminal and is constructed of an external cylindrical portion and an internal cylindrical portion which are concentrically formed together; and a means for preventing the insulation seal member from dislodging when the lamp plug is removed from the socket body, where the contact hooks extend in opposite directions when the lamp plug is plugged into the socket body and presses the internal cylindrical portion in the direction of the radius of the internal cylindrical portion to hold the insulation seal member in place.

* * * * *